United States Patent [19]

Del Gorio, Sr.

[11] Patent Number: 4,951,327

[45] Date of Patent: Aug. 28, 1990

[54] POOL COVER SUPPORT SYSTEM

[76] Inventor: Vito J. Del Gorio, Sr., 318 Bryant Ave., Staten Island, N.Y. 10306

[21] Appl. No.: 276,693

[22] Filed: Nov. 28, 1988

Related U.S. Application Data

[63] Continuation-in-part of Ser. No. 213,114, Jun. 29, 1988.

[51] Int. Cl.[5] ..... E04H 3/19

[52] U.S. Cl. ..... 4/498; 4/503; 135/144; 135/122

[58] Field of Search ..... 135/96, 98, 99, 108, 135/106, 114, 101, 112; 4/498, 499, 503, 504; 182/128, 111, 109

[56] References Cited

U.S. PATENT DOCUMENTS

| | | | |
|---|---|---|---|
| Re. 30,774 | 10/1981 | Dahlbeck et al. | 4/503 X |
| 1,669,611 | 5/1928 | Goldberg | 135/99 X |
| 2,117,373 | 5/1938 | Sobotka | 135/76 |
| 2,964,759 | 12/1960 | Riggs | 4/498 |
| 3,423,767 | 1/1969 | Crook | 135/96 X |
| 3,475,768 | 11/1969 | Burton | 4/498 X |
| 3,683,427 | 8/1972 | Burkholz et al. | 4/503 X |
| 4,061,154 | 12/1977 | Cox et al. | 135/36 R X |
| 4,257,132 | 3/1981 | Kerby | 4/498 |
| 4,566,475 | 1/1986 | Wund | 135/99 |
| 4,671,382 | 6/1987 | D'Alessio et al. | 182/128 |
| 4,683,983 | 8/1987 | Murphy | 182/111 X |
| 4,813,442 | 3/1989 | Haines | 135/98 |
| 4,852,689 | 8/1989 | Erion | 182/111 X |

FOREIGN PATENT DOCUMENTS

| | | | |
|---|---|---|---|
| 395172 | 3/1926 | Fed. Rep. of Germany | 135/108 |
| 2037165 | 2/1972 | Fed. Rep. of Germany | 135/99 |
| 1009982 | 6/1952 | France | 135/36 F |
| 53860 | 11/1967 | German Democratic Rep. | 135/99 |
| 278252 | 10/1928 | Italy | 135/36 |
| 416008 | 1/1967 | Switzerland | 182/111 |
| 2214799 | 9/1989 | United Kingdom | 4/498 |

*Primary Examiner*—David A. Scherbel
*Assistant Examiner*—Lan Mai
*Attorney, Agent, or Firm*—Roger S. Thompson; Thomas R. Morrison

[57] ABSTRACT

A swimming pool cover support system for maintaining the cleanliness of a pool during periods the pool is not in use includes at least one central support member, and a plurality of support arms. The top of the support member is positioned at a height greater than the distance from the bottom of the pool, at the location of the support member, to a height over the highest point on the side of the pool. Each of the plurality of support arms is attached at one end thereof to the top of the central support member, and at the other end thereof contacts a side of the pool. The other end of each support arm is secured to the side of the pool by means of a side brace affixed to the side of the pool. A cover is disposed over the central support member and support arms, and suspended thereby over the surface of the pool.

16 Claims, 3 Drawing Sheets

POOL COVER SUPPORT SYSTEM

CROSS REFERENCE TO RELATED APPLICATIONS

This application is a continuation-in-part of my earlier filed application, Ser. No. 213,114, filed June 29, 1988.

BACKGROUND OF THE INVENTION

The present invention relates to recreational items, and, more particularly, to a system for supporting a cover deployed over a personal swimming pool during the winter.

Many people, particularly in suburban areas, have personal swimming pools on their property. In those geographic areas, such as the Northeastern region of the United States, such pools, when used outdoors, are only useful during fair weather months.

During the cooler winter (and certain autumn and spring) months, the pool is not used, and there exists a problem with maintaining the pool in good operation, and with a suitable degree of cleanliness, during the extended periods when the pool is not in use.

It is conventional, for example, to deploy a cover over the pool each winter, to protect it from debris, etc. Such conventional covers generally include a planar waterproof cover which is set out over the surface of the water in the pool. In some installations, the cover is maintained in place by depositing heavy objects, such as rocks, cinder blocks or the like, on the outer ends thereof, beyond the outer edge of the pool. In other installations, the cover may be maintained in place by means of a clinching drawstring, or other arrangement. Debris accumulates on the cover, but, in theory, does not reach the surface of the water underneath the cover.

Conventional pool covers do not always perform satisfactorily in practice, however. Specifically, debris tends to accumulate in the center of the cover over the winter, and thereby render the cover difficult to remove. In fact, the accumulated debris may cause the cover to tear, causing the debris to fall into the pool (frustrating the very reason for having the cover in the first instance). Alternatively, the weight of the debris may make it difficult to remove, and, during the course of removal, the debris may fall, accidentally, into the pool.

Some people attempt to solve the problem of the accumulation of debris by placing an object, usually a beach ball or air pillow, under the cover, on the surface of the pool, thereby raising the surface of the cover over the lip of the pool. This provides some impetus for having the debris fall away from the pool, rather than accumulate in the pool. However, over time, and particularly during cold weather, the beach ball deflates, rendering it ineffective. Additionally, the beach ball may drift, permitting the cover to sag and accumulate debris in any event.

There is thus a need for a device which provides a means for preventing the accumulation of debris over the pool, and for maintaining the integrity of the cover over time.

OBJECTS AND SUMMARY OF THE INVENTION

Accordingly, it is an object of the invention to provide a swimming pool cover support system which overcomes the drawbacks of the prior art.

It is a further object of the invention to provide a swimming pool cover support system which includes a central support member for supporting the center of the cover above the surface of the pool.

It is a still further object of the invention to provide a swimming pool cover support system which will neither drift nor lower.

It is a still further object of the invention to provide a swimming pool cover support system which renders easier the removal of the cover after the winter.

Briefly stated, there is provided a swimming pool cover support system for maintaining the cleanliness of a pool during periods the pool is not in use. The support system includes at least one central support member, and a plurality of support arms. The top of the support member is positioned at a height greater than the distance from the bottom of the pool, at the location of the support member, to a height over the highest point on the side of the pool. Each of the plurality of support arms is attached at one end thereof to the top of the central support member, and at the other end thereof contacts a side of the pool. The other end of each support arm is secured to the side of the pool by means of a side brace affixed to the side of the pool. A cover is disposed over the central support member and support arms, and suspended thereby over the surface of the pool.

In accordance with these and other objects of the invention, there is provided a pool cover support system for supporting a pool cover over the surface of a pool, the pool having a bottom surface and an outer side, the system comprising: a first central support member, having a bottom adapted to engage the bottom surface of the pool and a top, the distance from the bottom of the first central support member to the top thereof being greater than a distance from the bottom surface of the pool to the top of the side of the pool; a center joint, having engaging means to engage the top of the first central support member, and also having a plurality of first receiving means; a plurality of side braces, each of the side braces including means for engaging the side of the pool, and a second receiving means; and a plurality of support arms, each of the support arms having a first end adapted to engage a respective first receiving means in the center joint and a respective second receiving means in a respective one of the plurality of side braces; whereby the support arms may be deployed radially about the first central support member, and may extend from the first central support member about the entire periphery of the pool, so that a pool cover may be arranged thereon above the surface of the pool.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
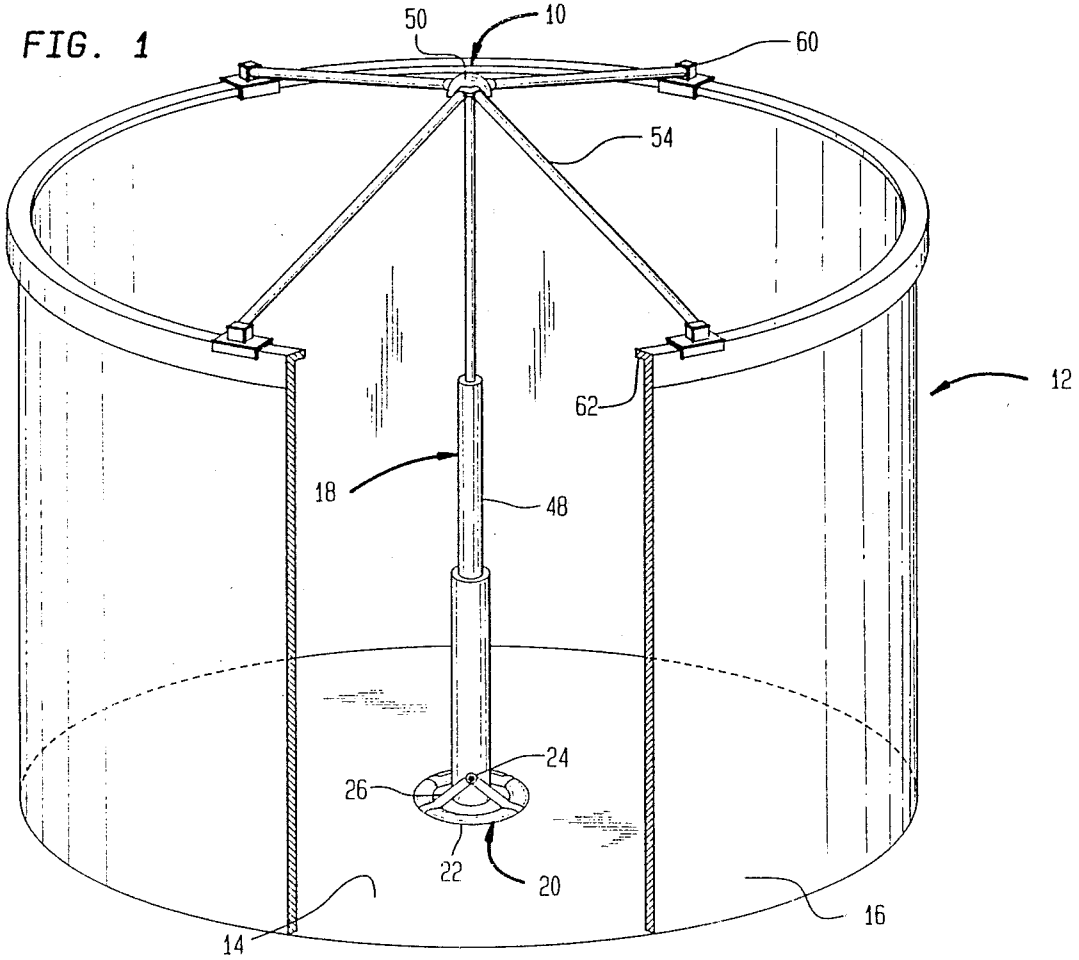
FIG. 1 is a perspective, shown partly broken away, of a pool cover support system in accordance with the invention, shown in use.

Referring now to FIG. 1, there is shown, generally at 10, a pool cover support system, in accordance with the invention. Pool cover support system 10 is intended to be deployed within a pool 12, having a bottom surface 14 and at least one wall 16. For purposes of illustration only, it is assumed that pool 12 is circular in shape, and that bottom surface 14 is sloped as shown. It will be appreciated by those of ordinary skill in the art that pool 12 could be of any desired shape, including square, rectangular, oval, etc., and that bottom surface 14 may be flat or have some other configuration without departing from the spirit and scope of the invention herein.

During use, of course, pool 12 would be filled with water, but that not being necessary for an understanding of the invention, it is omitted from FIG. 1.

Pool cover support system 10 includes a center support member 18, having a bottom 20. Bottom 20 is adapted to engage bottom surface 14 of pool 12, and may be of any desired configuration suitable to accomplish that end. For example, if pool cover support system 10 is to be used in a pool 12 having a sloped bottom surface 14 (as shown), bottom 20 may include a bottom surface engaging member 22 pivotably mounted to center support member 18 at a pivot point 24.

Figure 2:
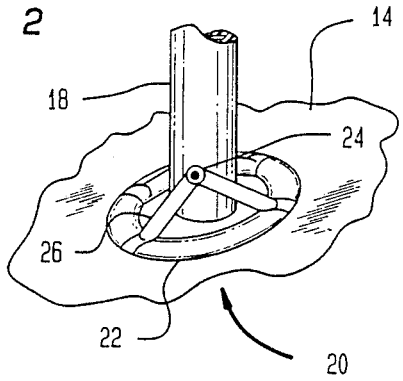
FIG. 2 a cross-section of a bottom surface engaging member of the system in FIG. 1.

A preferred embodiment of bottom 20 of center support member 18 is shown in more detail in FIG. 2. It is preferred that bottom surface engaging member 22 be configured so as to avoid damage to bottom surface 14 of pool 12, so bottom surface engaging member 22 should preferably be constructed of a soft or other sort of smooth material. A soft plastic would be acceptable. Alternatively, a rounded rustproof metal would also suffice. In the event that pool cover support system 10 is to be used with a pool 12 having a sloped bottom surface 14 (as shown in FIG. 1), it is also preferred that bottom 20 thereof be adaptable to any possible angle of slope. To this end, as shown in FIG. 2, bottom 20 is pivotably attached to center support member 18. Other possibilities exist as well.

Figure 3:
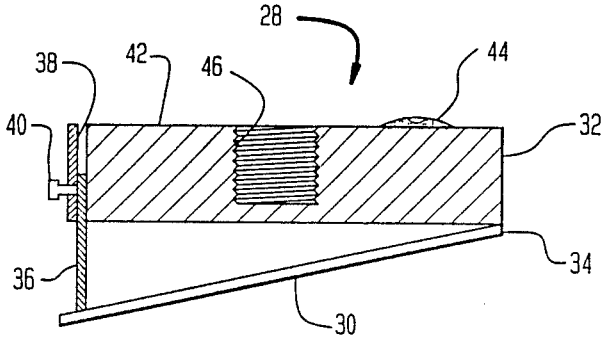
FIG. 3 is a cross-section of a bottom surface engaging member according to a secondary embodiment of the of invention.

For example, referring to FIG. 3, an alternative bottom 28 is shown. Here, bottom 28 includes a flat bottom surface engaging surface 30 intended to engage bottom surface 14 of pool 12. Bottom surface engaging surface 30 is pivotably mounted to a ballast 32 about a pivot point 34 at a first end thereof. At the opposing end thereof, bottom surface engaging surface 30 is spaced from ballast 32 by a spacer 36. Spacer 36 is preferably movably mounted to ballast 32 in any desired fashion, to provide varying positions of bottom surface engaging surface 30 with respect to ballast 32, for example by sliding within a slot 38. There is also provided means for affixing spacer 36 at a desired position, for example a set screw 40.

With this arrangement, any anticipated slope of if bottom surface 14 may be accommodated. For example, surface engaging surface 30 may be pivoted a small amount about pivot point 24 away from ballast 32, by sliding spacer 36 along slot 38. Once spacer 36 reaches the desired location, it is fixed there by set screw 40. The desired location would be one in which an upper surface 42 of ballast 32 is level when in place. This may be judged by eye, or by an optional level 44, for example a conventional bubble arrangement.

Where the slope of bottom surface 14 is known, or of a "standard" angle, a preformed rigid ballast 32, having a fixed bottom surface engaging surface 30 may be used.

As a final alternative, if used in a pool 12 having a flat bottom, ballast 32 may be simply a unitary block of material, having a flat ballast 32.

Each alternative is contemplated by the invention.

In any event, it is preferred that bottom 28 be made of a material which will not damage bottom surface 14 of pool 12, and will not deteriorate over time, when exposed to the environment of its intended use. It is further preferred that bottom 28 be capable of acting to balance pool cover support system 10, so that it should also be heavy when compared to the remainder of pool cover support system 10, and that it be made of a material which will not mar the surface of the liner of pool 12. Anodized metal, plastic-coated wood or a hollow soft plastic shell filled with sand are all considered acceptable, but those of ordinary skill in the art will be able to choose a material suitable for the desired application without undue experimentation.

Bottom 28 also includes means for engaging center support member 18, for example a threaded bore 46 adapted to engage a respective threaded end (not shown) of center support member 18. Threaded bore 46 should be disposed so as to permit center support member 18 to be retained thereby in a substantially vertical position when deployed, so that pool cover support system 10 may be held in a suitable orientation when in use.

Returning now to FIG. 1, it is preferred that center support member 18 may be adjustable for pools 12 of differing depths, as well as differing slopes of their respective bottom surfaces 14. To accomplish this end, center support member 18 is preferably made of several different vertical support members 48, which are movably affixed to one another, thereby providing the capacity for adjusting the height of center support member 18 to a desired level.

For example, vertical support members 48 may be capable of telescoping, in known fashion, between different relative positions, so that the overall height of center support member 18 may be varied within predetermined limits. Stop means (not shown) would limit the total range of motion, and also secure vertical support members 48 in their desired positions.

In an alternative embodiment (not shown), center support member 18 may be of a fixed height, so long as that height is suitable for the invention, as will be described presently.

Thus, any means may be employed for providing support for pool cover support system 10 from bottom surface 14 of pool 12, and those of ordinary skill in the art would be well able to provide a satisfactory support without undue experimentation.

A center joint 50 is disposed atop center support member 18. Center joint 50 includes means for securing center joint 50 to the uppermost vertical support member 48 of center support member 18, such as a threaded end 52 adapted to engage a respective threaded end (not shown) of center support member 18. As will be appreciated by those of ordinary skill, other suitable means may also be provided, such as a snap fitting, a lock-and-key arrangement, etc. The actual method of removably securing center joint 50 to center support member 18 is irrelevant to the practice of the invention.

Preferably, center joint 50 includes a rounded top 53, giving center joint 50 the cross-sectional appearance of a mushroom, so that when a pool cover (not shown) is deployed thereon, it will not be damaged by the projection of center joint 50 therethrough. Center joint 50 may be made of any suitable material, such as the materials listed with respect to forming center support member 18. A preferred embodiment would have center joint 50 formed in a single shot injection molding process, although it may also be preferable to have the interior thereof comprised of a web arrangement (not shown), to reduce the amount of material needed therefor, thereby requiring two shots of injection molding in known fashion.

Figure 4:
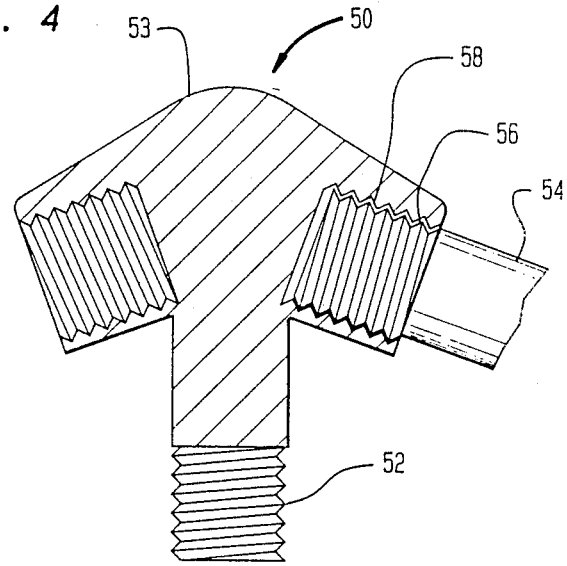
FIG. 4 is a cross-section of a center joint the system of FIG. 1, showing the manner in which the center joint engages a support arm according to the invention.

A plurality of support arms 54 (only one of which is shown in FIG. 4) are removably affixed to center joint 50, for example by engaging a first threaded end 56 thereof with a mating threaded bore 58 of center joint 50. Again, other means for removably affixing first threaded end 56 and threaded bore 58 are possible, but these other means, being clear to those of ordinary skill in the art, are omitted herefrom. The proper number of support arms 54 for a given application will depend upon the size and shape of the pool to be covered, and is a function of the estimated weight of the cover and any debris which is expected to accumulate. Thus, in heavily wooded areas, where more debris such as leaves, twigs and the like, would be expected, more support arms 54 would be required than in relatively open areas with little expected debris, or in screened-in pools, where much debris would be naturally excluded. It has been determined that, for a standard above-ground pool having a diameter of approximately 20 (twenty) feet, in a moderately wooded environment, eight support arms 54 are preferred.

It will therefore be appreciated that the illustrated embodiment, showing four support arms 54, is for ease of illustration only.

It is preferred that each threaded bore 58 in center joint 50 be angled so as to provide an angle of approximately ten degrees with respect to horizontal, for reasons described below.

Referring again to FIG. 1, a respective plurality of side braces 60 are arranged at the opposing ends of support arms 54. Each support arm 54 has associated therewith a respective side brace 60, disposed about a lip 62 of wall 16. The precise configuration of side braces 60 will depend on the configuration of the type of pool 12 with which it is to be used. For purposes of this discussion, it is assumed that wall 16 of pool 12 has a lip 62, although, as will be described, this is not necessarily the case.

Figure 5:
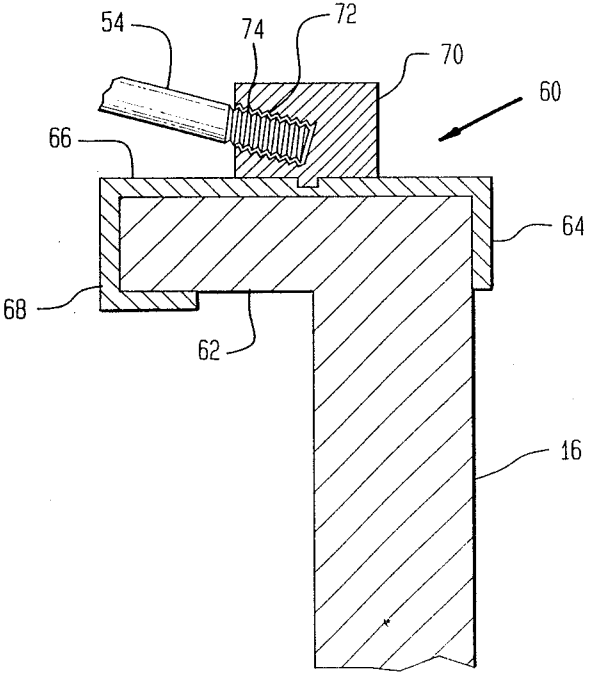
FIG. 5 is a cross-section of a side brace of the system of FIG. 1.

A detail of side brace 60 is shown in FIG. 5. Side brace 60 is shaped to conform to lip 62, which in this instance means that it includes a generally vertical exterior portion 64, attached to a generally horizontal portion 66, ending in an interior lip-engaging portion 68. A support arm receiving housing 70 is disposed atop horizontal portion 66, and includes a support arm engaging means, such as a threaded bore 72 therein. Support arm receiving housing 70 may be formed integrally with the remainder of side brace 60, or may be made separately (as shown). Threaded bore 72 is adapted to receive a second threaded end 74 of support arm 54. It is preferred that threaded bore 72 be angled to the same extent as threaded bore 58 in center joint 50, so that they may be deployed co-axially. In the preferred embodiment, this entails an angling of approximately ten degrees with respect to horizontal.

In order to provide flexibility in deploying support arms 54, they may also be capable of adjustment in length, such as by telescoping or other known means.

In operation, pool cover support system 10 serves to support a cover for a pool when that pool is not in use.

To deploy pool cover support system 10 in pool 12, the user must first establish the slope of bottom surface 14 at approximately the middle of pool 12. If the slope is known, for example if bottom surface 14 is perfectly flat, then the angle of bottom 20 may be set on the exterior of pool 12. If the slope is not known, then the user must first ascertain the slope.

This may be done before the pool is filled the first time, by going to the middle of the (dry) bottom surface 14, and leveling bottom 20, for example by use of level 44 (FIG. 3). Alternatively, if pool 12 is full, and it is preferred not to empty it, then the leveling would be performed under water. It should not take more than a few seconds, so that anyone capable of holding their breath for a few seconds would be also capable of leveling pool cover support system 10.

Once the leveling is accomplished, center support member 18 is affixed to bottom 20, and adjusted to the desired height, for example by telescoping vertical support members 48 to that height. At the proper height, center joint 50 would be higher than the highest point of wall 16 of pool 12, so that any cover attached thereto would be completely above wall 16.

Support arms 54 are then attached to center joint 50, to provide support for the cover. It is preferred that each support arm 54 be attached to center joint 50 and then affixed at its opposing end to a respective side brace 60, which is then clipped over lip 62. In most instances, it is believed that the clipping of side brace 60 to lip 62 will provide sufficient gripping action to prevent movement of side brace 60 with respect to wall 16. However, in the case of pools having no lip 62, for example certain completely below-ground pools, side braces 60 having no exterior portion 64 must be employed. In such instances, it is preferred that each support arm 54 include a tensioning means (not shown), such as an adjustable tension spring within that support arm 54, for providing longitudinal pressure along the axis of support arm 54, for retaining that support arm 54 in place.

Once pool cover support system 10 is fully installed, the cover may be arranged thereover and secured in any known fashion, forming an umbrella-shaped supported cover system over the surface of pool 12. Since the installed system is completely over pool 12, and the highest point thereof is higher than the edge of pool 12, debris tends to fall from the cover, and not accumulate thereon. The angling of support arms 54 downwardly away from center joint 50 acts to increase the tendency of the debris to fall away from the center of pool 12.

By virtue of the stable center support member 18, and the arrangement of support arms 54, there is a substantial avoidance of accumulation of debris in pockets of the cover, and the center point thereof will neither drift lower over time. Thus, the removal of the cover is facilitated at the commencement of the warmer season, and cleaning up is made much easier.

The deploying of pool cover support system 10 is thus a fairly simple operation, for any pool, and renders the previously difficult and time-consuming task of removing the cover from a pool easy and relatively quick.

Furthermore, the components of pool cover support system 10 are relatively inexpensive and simple to manufacture, so that the inventive system may be afforded by anyone having a pool, and the components thereof having no moving or complicated parts, are not prone to breakdown. In addition, it is believed that, over time, the inventive system will actually save the user money, as well as time, since it is believed that the prevention of the accumulation of debris in the cover will render the cover less prone to ripping and therefore less likely to require replacement thereof.

Figure 6:
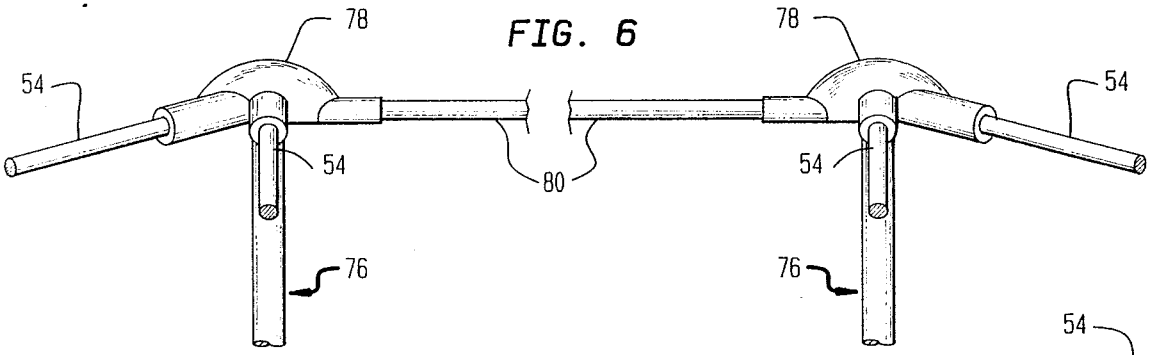
FIG. 6 is a partial perspective of a secondary embodiment of the invention, showing the use of two central support members.

A secondary embodiment of the invention is shown in FIG. 6, wherein two center support members 76 are shown. Such an embodiment would be required where the pool is larger, or has an unusual shape, such as kidney shaped. In such an arrangement, each center support member 76 includes a center joint 78 identical to center joint 50, except that one support arm receiving means (not separately shown) is not angled with respect to horizontal, but is instead actually horizontal, providing means for receiving a single horizontal central support arm 80 joined to each center joint 78. The use of horizontal central support arm 80 locks the two center support members 76 in relatively stationary positions, thereby permitting the deployment of a larger cover to cover the larger or unusually shaped pool. It will be appreciated of course, that other customized arrangement may be called for in certain instances, but, based upon the teachings herein, it is believed that anyone of ordinary skill in the art could design an appropriate pool cover support system without undue experimentation.

It may also be possible to design a built-in pool cover support system for any pool, wherein the support arms are secured to the side of the pool in pre-built side braces which are installed within the side wall of the pool, for example by having means for attaching a support arm receiving housing thereto, without the need for a separate means for attaching that support arm receiving housing to the side of the pool. Such a built-in pool cover support system may also include means for securing the center support member, pre-built into the bottom of the pool, so that no separate bottom member, such as bottom surface engaging member 22 (FIGS. 1 and 2) is required. Such a system would also make it possible to avoid the use in leveling means, since the support would be pre-built at the desired incline.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A pool cover support system for supporting a pool cover over the surface of a pool, the pool having a bottom surface and an outer side, said system comprising:

a first central support member, having a bottom adapted to engage the bottom surface of the pool and a top, the distance from said bottom of said first central support member to said top thereof being greater than a distance from the bottom surface of the pool to the top of the side of the pool;

a center joint, having engaging means to engage said top of said first central support member, and also having a plurality of rist receiving means;

a plurality of side braces, each of said side braces including means for engaging the side of the pool, and a second receiving means; and a plurality of support arms, each of said support arms having a first end adapted to engage a respective first receiving means in said center joint and a respective second receiving means in a respective one of said plurality of side braces;

whereby said support arms may be deployed radially about said first central support member, and may extend from said first central support member about the entire periphery of the pool, so that a pool cover may be arrange thereon above the surface of the pool.

2. The pool cover support system of claim 1, wherein said top of said first central support member is threaded, and said means for engaging said top of said first central support member includes an element threaded to engage said threads on said top of said first central support member.

3. The pool cover support system of claim 1, further comprising a second central support member.

4. The pool cover support system of claim 3, further comprising a central support arm, having a first end adapted to engage said engaging means of said center joint of said first central support member, and a second end adapted to engage a second engaging means of a second center joint atop said second central support member.

5. The pool cover support system of claim 1, wherein said first central support member is adapted to telescope to different lengths.

6. The pool cover support system of claim 1, wherein at least once of said side braces includes securing means for removably securing said one of said side braces to the side of the pool.

7. The pool cover support system of claim 6, wherein said side brace includes a removable housing fore receiving said support arms.

8. The pool cover support system of claim 6, wherein the pool includes a lip, and also wherein said side brace includes means for engaging said lip.

9. The pool cover support system of claim 1, wherein said support arms are made of waterproofed wood.

10. The pool cover support system of claim 1, wherein said support arms are made of water-resistant metal.

11. The pool cover support system of claim 1, wherein at least one of said plurality of support arms is capable of telescoping to different lengths.

12. The pool cover support system of claim 1, wherein said support arms are made of rigid plastic.

13. The pool cover support system of claim 1, further including means for removably securing the cover to at least one of said support arms, said center joint and said side braces.

14. A pool cover support system of supporting a poll cover over the surface of a pool, the pool having a bottom surface and an outer side, said system comprising:

a first central support member, having a bottom adapted to engage the bottom surface of the pool and a top, the distance from said bottom of said first central support member to said top thereof being greater than a distance from the bottom surface of the pool to the top of the side of the pool, said bottom of said central support member including means for adapting the orientation thereof to accommodate a pool having a sloped surface;

a center joint, having engaging means to engage said top of said first central support member, and also having a plurality of first receiving means;

a plurality of side braces, each of said side braces including means for engaging the side of the pool, and a second receiving means; and a plurality of support arms, each of said support arms having a first end adapted to engage a respective first receiving means in said center joint and a respective second receiving means in a respective one of said plurality of side brace;

whereby said support arms may be deployed readily about said first central support member, sand may extend from said first central support member about the entire periphery of the pool, so that a pool cover may be arranged thereon above the surface of the pool.

15. The pool cover support system of claim 14, wherein said means for adapting includes pivoting means for pivoting a bottom support member about an axis to permit the orientation thereof to compliment the orientation of the bottom of the pool at the location in which said first central support member is disposed.

16. The pool cover support system of claim 14, wherein said means for adapting includes an angled member having a bottom surface configured to conform to the slope of the bottom surface of the pool.

* * * * *